US010723546B2

(12) United States Patent
Wegener

(10) Patent No.: US 10,723,546 B2
(45) Date of Patent: Jul. 28, 2020

(54) CONTAINER FOR THE TRANSPORT OF A VEHICLE

(71) Applicant: IQS Holding GmbH, Langenbach (DE)

(72) Inventor: Norbert Wegener, Kumhausen (DE)

(73) Assignee: IQS Holding Gmbh (DE)

( * ) Notice: Subject to any disclaimer, the term of this patent is extended or adjusted under 35 U.S.C. 154(b) by 0 days.

(21) Appl. No.: 16/193,545

(22) Filed: Nov. 16, 2018

(65) Prior Publication Data

US 2019/0152691 A1 May 23, 2019

(30) Foreign Application Priority Data

Nov. 17, 2017 (DE) ..... 10 2017 010 689

(51) Int. Cl.

| | |
|---|---|
| ***B65D 88/12*** | (2006.01) |
| ***B65D 88/14*** | (2006.01) |
| ***B65D 90/18*** | (2006.01) |
| ***B65D 88/54*** | (2006.01) |
| ***B65D 90/00*** | (2006.01) |
| *B65D 85/68* | (2006.01) |

(52) U.S. Cl.

CPC ..... *B65D 88/127* (2013.01); *B65D 88/14* (2013.01); *B65D 88/542* (2013.01); *B65D 90/006* (2013.01); *B65D 90/0033* (2013.01); *B65D 90/18* (2013.01); *B65D 85/68* (2013.01); *B65D 2585/686* (2013.01); *B65D 2588/12* (2013.01); *B65D 2588/54* (2013.01)

(58) Field of Classification Search

CPC ..... B65D 88/127; B65D 88/542; B65D 90/0033; B65D 90/006; B65D 90/008; B65D 2588/12; B65D 2588/54

USPC ..... 410/4

See application file for complete search history.

(56) References Cited

U.S. PATENT DOCUMENTS 1,740,000 A * 12/1929 Andrews ..... B65D 88/542 220/1.5
3,710,513 A * 1/1973 Richter ..... B60J 5/062 49/464
4,682,811 A * 7/1987 Ooguro ..... B60J 5/0498 105/378

(Continued)

FOREIGN PATENT DOCUMENTS

CN 103587841 A 2/2014
DE 2601128 A1 7/1976

(Continued)

*Primary Examiner* — Hilary L Gutman
(74) *Attorney, Agent, or Firm* — St. Onge Steward Johnston & Reens, LLC

(57) ABSTRACT

The invention relates to a container for transporting a vehicle therein, which is essentially rectangular in construction with a first and a second end face, two long sides, a bottom, and a top, wherein the container has a floor element, a frame structure, and at least two cover elements, wherein the at least two cover elements cover the end faces, the long sides, and the top of the container when in the closed state, and the floor element covers the bottom of the container, and wherein the frame structure builds on the floor element and, in the region of the top, the at least two cover elements are hinged to the frame structure in such a way that they can be swung upward away from the floor element when the container is in an open state.

9 Claims, 2 Drawing Sheets

(56) References Cited

U.S. PATENT DOCUMENTS

| | | | | |
|---|---|---|---|---|
| 6,247,747 | B1 * | 6/2001 | Kawanomoto | B60J 5/0498 296/191 |
| 9,714,137 | B2 | 7/2017 | Hamilton et al. | |
| 2004/0232021 | A1 | 11/2004 | Linton | |
| 2008/0226435 | A1 * | 9/2008 | Patterson | B65D 88/542 414/377 |
| 2012/0024851 | A1 * | 2/2012 | Strasser, Sr. | B60J 5/0498 220/211 |
| 2013/0036673 | A1 * | 2/2013 | Wassenaar | B60J 5/0498 49/324 |
| 2013/0284730 | A1 * | 10/2013 | Kohlgruber | B65D 88/005 220/1.5 |
| 2016/0137407 | A1 * | 5/2016 | Skeid | B65D 90/008 206/598 |

FOREIGN PATENT DOCUMENTS

| | | | | |
|---|---|---|---|---|
| DE | 20012717 | U1 | 9/2000 | |
| DE | 202010014914 | U1 | 3/2011 | |
| DE | 102010042510 | A1 | 4/2012 | |
| JP | H07117483 | A | 5/1995 | |
| JP | 2004268759 | A | 9/2004 | |
| WO | WO-2009113539 | A1 * | 9/2009 | B60J 5/0498 |
| WO | WO-2011110725 | A1 * | 9/2011 | B65D 88/005 |
| WO | WO-2013020154 | A1 * | 2/2013 | B65D 88/127 |
| WO | WO-2016110709 | A1 * | 7/2016 | B65D 90/0033 |
| WO | WO-2016154655 | A1 * | 10/2016 | B65D 88/127 |
| WO | 2017006232 | A1 | 1/2017 | |
| WO | WO-2017083895 | A1 * | 5/2017 | B60J 5/0498 |

* cited by examiner

CONTAINER FOR THE TRANSPORT OF A VEHICLE

FIELD OF THE INVENTION

The invention relates to a container for the transport of a vehicle according to the preamble of claim 1.

BACKGROUND OF THE INVENTION

A container for transporting a vehicle therein is essentially rectangular in construction with a first and a second end face, two long sides, a bottom, and a top.

With a container of this nature, vehicles are transported, sometimes over great distances, such that they are protected from damage. Moreover, vehicles transported therein are protected from improper access and unauthorized examination. This is especially desirable in the transport of prototypes, race cars, and rare vintage vehicles.

Corresponding containers are also used in air freight, for example. In this context, it is especially important to ensure that such containers fit within the contour of an aircraft cargo compartment. Nonetheless, the problem often exists with prior art containers that it is difficult to load the corresponding vehicle into them because, as mentioned, these containers cannot exceed a certain size, and thus also cannot exceed a certain maximum internal size. A driver who drives a vehicle into such a container must be able to exit the vehicle and the container through lateral openings. This requires different openings or limits the size of the vehicles that can be loaded in such containers, since vehicle doors cannot be opened far enough to exit, for example. The stability of such containers can also suffer on account of additional openings in the side walls or end walls. Multiple different openings in such containers also require that each of these openings must be individually secured against being opened without authorization.

Published German application document DE 10 2010 042 510 A1 describes a container for the transport of a vehicle in which a cover with an access door is arranged over a floor element so as to be movable.

It is therefore the object of the present invention to provide a container for transporting a vehicle therein, in particular a container for transport via air freight, which on the one hand offers maximum possible stability while at the same time permitting the simplest possible loading and unloading of a vehicle, and also is matched in terms of dimensions to existing cargo compartments in aircraft as optimally as possible.

This object is attained with the subject matter of independent claim 1. Advantageous improvements to the invention are evident from the dependent claims.

SUMMARY OF THE INVENTION

The container according to the invention for transporting a vehicle therein, in particular via air freight, which is to say, in particular, an air freight container, is essentially rectangular in construction with a first and a second end face, two long sides, a bottom and a top. In the region of the top, a part of the container according to the invention can, in this design, be arranged to be inclined such that loading in an aircraft cargo compartment is possible in cross-section. The container according to the invention has a floor element, a frame structure, and at least two cover elements. When the container is in the closed state, the at least two cover elements cover the end faces, the long sides, and the top of the container. The floor element covers the bottom of the container, so that the vehicle loaded in the container is not visible, and also not accessible, from the outside when the container is in the closed state. The frame structure builds on the floor element, and, in the region of the top, the at least two cover elements are hinged to the frame structure in such a way that they can be swung upward away from the floor element when the container is in an open state. Consequently, simple loading and unloading of the container according to the invention is possible when the container is in the open state. The frame structure is rigidly attached to the floor element, and the at least two cover elements are attached to the frame structure in a movable, hinged manner.

With the container according to the invention, a stable transport container is provided in a structurally simple manner that can offer easy handling without significant difficulties during loading and unloading, and good stability while requiring relatively little space. The corresponding container is simple to lock, since essentially only two elements are present, namely cover elements that preferably are each one piece, which are accordingly swung up for opening.

The structure of the container according to the invention is especially simple when the at least two cover elements are hinged to the frame structure by at least one rotary element so as to be individually pivotable, preferably, in particular, to a member of the frame structure that extends centrally in the longitudinal direction of the container. In this context, "individually pivotable" means that each of the at least two cover elements can be swung up on its own, so that access to a vehicle is possible as appropriate from only one side, without it being necessary to also swing up the respective other cover element. The rotary element here can be a rotary bearing or an element in the manner of a piano hinge in each case.

Preferably, the at least one rotary element, or the resultant axis of rotation, extends in the longitudinal direction of the container. The at least one rotary element in this case is attached to the frame structure on the one hand, and to at least one of the applicable cover elements on the other hand.

For easier handling, in particular during opening of the container according to the invention, the at least two cover elements are spring-loaded by gas spring elements with respect to the frame structure such that an opening motion of the at least two cover elements is at least supported in terms of force when being swung up into the open state, and the at least two cover elements are held in the open state by the force of the gas spring elements. Preferably, one gas spring element is associated with each cover element at each of the end faces of the container according to the invention.

The container according to the invention preferably can be locked especially easily by the means that the at least two cover elements can be locked to the floor element by at least one locking element in such a manner that they cannot be swung up from the floor element into the open state. For this purpose, the locking element can, for example, lock the two cover elements to one another, or the locking element can also individually lock each of the two cover elements to the frame structure, or each of the cover elements can be locked to the arrangement in the region of the floor element.

Preferably, the at least one locking element in this case can be equipped with elements for customs sealing.

In order to provide a device for easily driving a vehicle into the container according to the invention in a space-saving manner, preferably a ramp is provided at the first end face of the container that is pivotably attached to the floor element of the container such that, on the one hand it can be pivoted into the container so that it can be locked to the frame structure essentially perpendicular to the bottom, and on the other hand it can be pivoted outward so that it can serve as a loading ramp for the floor element. The perpendicular storage is advantageous, since little storage space is required for such a loading ramp as a result. The loading ramp can be attached to the frame structure by clamping levers, for example. In the closed state of the container, the loading ramp is thus located in the interior of the container according to the invention, and is protected accordingly.

In order to have access, at least possible visual contact or the like, to the interior of the container even in the essentially closed state of the container where appropriate, or in order to integrate additional elements into the container inner region, according to the invention at least one of the at least two cover elements can have an additional service opening. Consequently, manipulation is possible in the region of the service opening without the need to open the entire container.

For especially secure fastening of the vehicle in the container, the latter preferably has, in the region of the floor element, a perforated drive-on device suitable for driving a vehicle onto so that a vehicle can be locked in place on the drive-on device.

For easy handling of the container according to the invention, for example during aircraft loading and unloading operations, the container according to the invention has, in the region of the floor element on at least one long side, a pocket for a lifting element of an industrial truck.

For easier handling and for maneuvering under restricted spatial conditions, the floor element has, preferably at the second end face, at least one support element that can rotate about itself, on which the container can be moved when it is lifted at the first end face. The rotatable support element here can be provided essentially in roller shape or in the form of two rollers in the floor element in the applicable region of the end face.

BRIEF DESCRIPTION OF THE DRAWINGS

The invention shall be described in detail below on the basis of the embodiment explained by way of example.

DETAILED DESCRIPTION OF THE INVENTION

Figure 1:
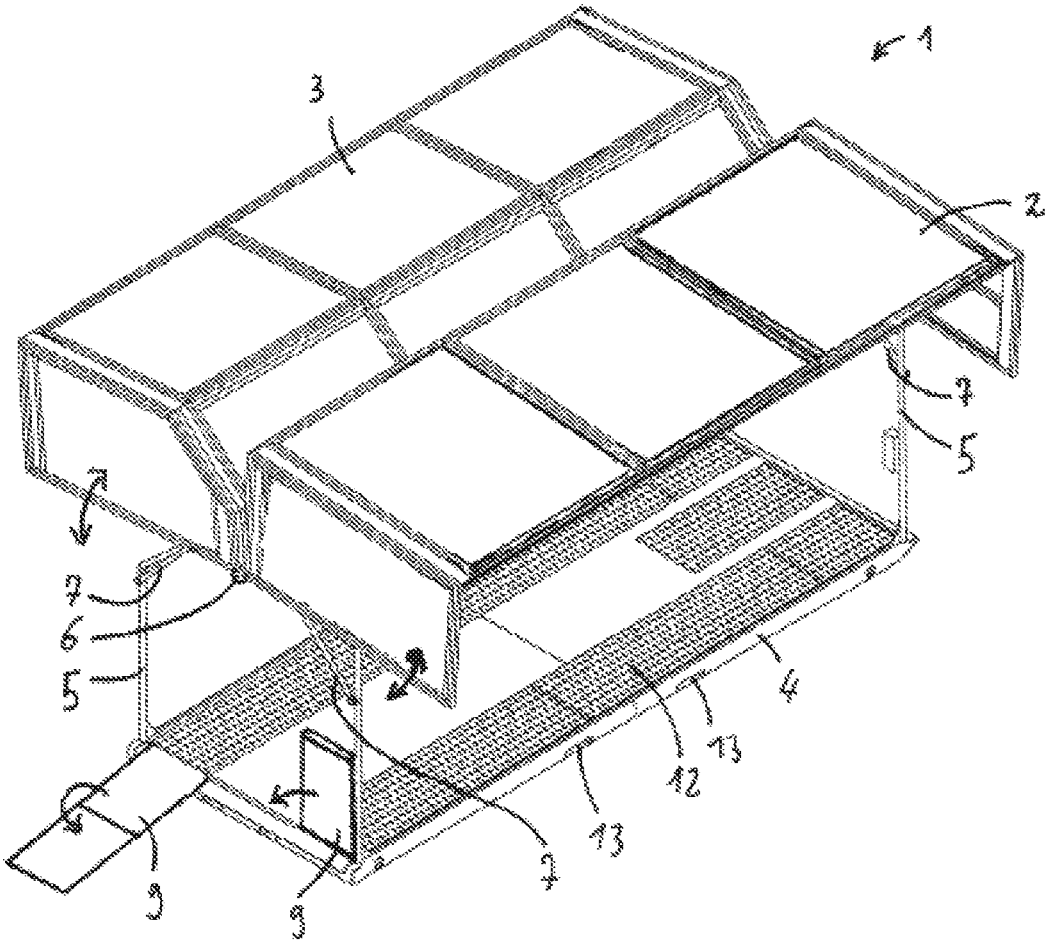
FIG. 1 shows a schematic, perspective view of a container according to one embodiment of the invention, in the open state.

The container 1 has a frame structure 5, which builds on the floor element 4 there, and which has, in the region of the top there, the at least two cover elements 2, 3 hinged in individually pivotable fashion to the frame structure 5 by means of a rotary element 6 extending in the longitudinal direction, so that the respective cover elements can be swung upward and away from the floor element 4, as shown in FIG. 1, when the container is in the open state. The pivoting motions of the individual cover elements 2, 3 are shown in FIG. 1 by corresponding double-headed arrows. Gas spring elements 7 spring-load the cover elements 2, 3 with respect to the frame structure 5 such that they can be held in position by force in the open state. The floor element 4 has a perforated drive-on device 12 suitable for driving a vehicle onto so that a vehicle can be locked in place on the drive-on device 12. On the long side of the floor element 4, a pocket 13 for a lifting element of an industrial truck is provided. Located at the first end face of the container is a ramp 9 that is pivotably attached to the floor element 4 of the container and that on the one hand can be pivoted into the container so that it can be locked to the frame structure essentially perpendicular to the bottom, and on the other hand can be pivoted outward so that it can serve as a ramp 9 for driving up onto the floor element 4. In the representation in FIG. 1, the ramp 9 is designed as multiple parts with two ramp elements apiece that are folding and are each associated with one side of a vehicle so that the ramp does not extend over the entire width of the container, instead being located solely in the region of the wheels of a corresponding vehicle driving up thereon. This permits a corresponding weight reduction.

It should be noted that the frame structure 5 can be made of metal bars, which provide the requisite stability, wherein the frame structure 5 is rigidly attached to the floor element 4.

Figure 2:
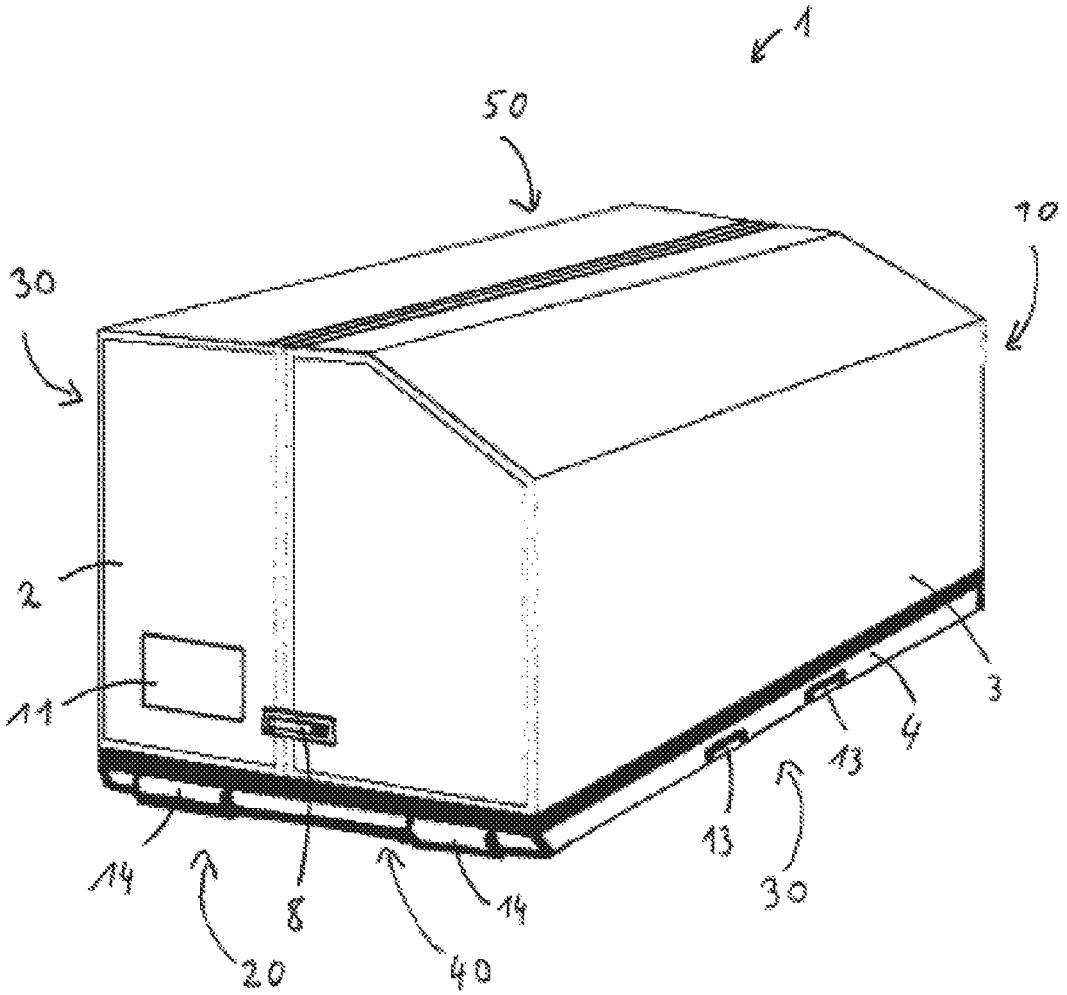
FIG. 2 shows a schematic, perspective view of the container from FIG. 1 in the closed state.

The container from FIG. 1 is shown in the closed state in FIG. 2. Components with the same functions as in FIG. 1 are labeled with the same reference numbers, and are not discussed separately.

Easily visible in FIG. 2 is the essentially rectangular design of the container according to the invention with a first end face 10 and a second end face 20, two long sides 30, a bottom 40, and a top 50. A locking element 8 locks the at least two cover elements 2, 3 such that they cannot be swung up into the open state from the floor element when they are in the closed and locked state shown. An additional service opening 11 in the region of the second end face 20 of the container 1 can also be seen in FIG. 2. Likewise visible in the representation in FIG. 2 is the embodiment of the rotatable support element 14 implemented as two rollers, by which means the container can be moved when it is lifted at the first end face 10.

Even though at least one exemplary embodiment has been shown in the foregoing description, various changes and modifications may be made. The said embodiment is merely an example, and is not intended to limit the scope of validity, the applicability, or the configuration of the container in any way. Rather, the foregoing description provides the person skilled in the art with a plan for implementation of at least one exemplary embodiment of the container according to the invention, wherein numerous changes may be made in the function and the design of the container from components described in the exemplary embodiment without departing from the scope of protection of the attached claims and their legal equivalents.

What is claimed is:

1. An essentially rectangular container for transporting a vehicle, comprising:

a first end face, a second end face, two long sides, a bottom, a top, a floor element, a frame structure, and at least two cover elements, wherein the at least two cover elements cover the end faces, the two long sides, and the top of the container when in a closed state, and the floor element covers the bottom of the container, and wherein the frame structure builds on the floor element and, in the region of the top, the at least two cover elements are hinged to the frame structure in such a way that they can be swung upward away from the floor element when the container is in an open state, and wherein the frame structure is rigidly and immovably attached directly to the floor element whether the container is in the closed state, the open state, or at any position therebetween.

2. The container according to claim 1, wherein the at least two cover elements are hinged to the frame structure by at least one rotary element so as to be individually pivotable.

3. The container according to claim 1, wherein the at least two cover elements are spring-loaded by gas spring elements with respect to the frame structure such that an opening motion of the at least two cover elements is at least supported in terms of force when being swung up into the open state, and the at least two cover elements are held in the open state by the force of the gas spring elements.

4. The container according to claim 1, wherein the at least two cover elements can be locked by at least one locking element in such a manner that they cannot be swung up into the open state from the floor element when they are locked in the closed state.

5. The container according to claim 1, further comprising a ramp located at the first end face of the container, the ramp being pivotably attached to the floor element of the container such that, on the one hand it can be pivoted into the container so that it can be locked to the frame structure essentially perpendicular to the bottom, and on the other hand it can be pivoted outward so that it can serve as a ramp for driving a vehicle onto the floor element.

6. The container according to claim 1, wherein at least one of the at least two cover elements has a service opening.

7. The container according to claim 1, wherein the floor element has a perforated drive-on device suitable for driving a vehicle onto so that a vehicle can be locked in place on the drive-on device.

8. The container according to claim 1, wherein the floor element has, on a long side, a pocket for a lifting element of an industrial truck.

9. The container according to claim 1, wherein the floor element has, at the second end face, at least one support element that can rotate about itself, on which the container can be moved when it is lifted at the first end face.

* * * * *